US005740740A

United States Patent [19]

Stephan

[11] Patent Number: 5,740,740

[45] Date of Patent: Apr. 21, 1998

[54] METHOD AND DEVICE FOR BRAKING SHEETS IN A DELIVERY OF A SHEET-FED ROTARY PRINTING PRESS

[75] Inventor: Günter Stephan, Wiesloch-Baiertal, Germany

[73] Assignee: Heidelberger Druckmaschinen AG, Heidelberg, Germany

[21] Appl. No.: 681,819

[22] Filed: Jul. 29, 1996

[30] Foreign Application Priority Data

Jul. 27, 1995 [DE] Germany ..... 195 27 440.7
Jul. 2, 1996 [DE] Germany ..... 196 26 369.7

[51] Int. Cl.[6] ..... B41F 13/64

[52] U.S. Cl. ..... 101/483; 101/240

[58] Field of Search ..... 101/483, 232, 101/240, 241, 242; 271/182, 195

[56] References Cited

U.S. PATENT DOCUMENTS

| | | | |
|---|---|---|---|
| 3,975,012 | 8/1976 | Matthews | 271/183 |
| 4,085,930 | 4/1978 | Weisgerber et al. | 271/204 |
| 5,263,415 | 11/1993 | Pollich | 101/232 |
| 5,497,987 | 3/1996 | Henn et al. | 271/204 |

FOREIGN PATENT DOCUMENTS

| | | |
|---|---|---|
| 1 148 241 | 5/1963 | Germany . |
| 25 44 566 | 4/1977 | Germany . |
| 39 38 863 A1 | 5/1991 | Germany . |
| 43 44 040 C1 | 3/1995 | Germany . |
| 43 43 713 A1 | 6/1995 | Germany . |
| 901 906 | 7/1962 | United Kingdom . |
| 2 293 369 | 3/1996 | United Kingdom . |

*Primary Examiner*—Edgar S. Burr
*Assistant Examiner*—Dave A. Ghatt
*Attorney, Agent, or Firm*—Herbert L. Lerner; Laurence A. Greenberg

[57] ABSTRACT

Method for braking sheets in a delivery of a sheet-fed rotary printing press wherein the sheets are disposed in tandem and are successively fed to a sheet-pile position in translatory travel direction, the sheets being in an overlapping shingled arrangement in a vicinity of a sheet brake, an air-blast jet being applied beneath and parallel to the respective sheets, includes feeding the sheet to the sheet brake by means of gripper closure and a flotation-guiding arrangement, forming with the air-blast jet a carrying-air flow for producing the flotation-guiding arrangement and for simultaneously separating the sheets from an instant at which the sheets are being formed into the overlapping shingled arrangement, the carrying-air flow formed beneath an oncoming sheet continuing in the vicinity of the overlapping shingled arrangement of the sheets for forming an elongation of the flotation-guiding arrangement towards the delivery; and a device for performing the method.

8 Claims, 2 Drawing Sheets

METHOD AND DEVICE FOR BRAKING SHEETS IN A DELIVERY OF A SHEET-FED ROTARY PRINTING PRESS

BACKGROUND OF THE INVENTION

Field of the Invention

The invention relates to a method and a device for braking sheets in a delivery of a sheet-fed rotary printing press wherein the sheets are disposed in tandem and are successively fed to a sheet-pile position in translatory travel direction, the sheets being in an overlapping shingled arrangement in a vicinity of a sheet brake, an air-blast jet being applied beneath and parallel to the respective sheets.

For the purpose of reducing the travel speed of the sheets in the delivery, it has become known heretofore to provide suction tapes or suction rollers which revolve at a slower speed than the operating speed of the printing press and apply suction to the respective sheets. Furthermore, it has become known heretofore from the published German Patent Document DE-AS 21 35 105, to blow blast air underneath an oncoming sheet over the entire width or breadth thereof, the sheet being initially held yet at a leading edge thereof by sheet grippers of a transport system, the blast air being directed opposite to the sheet travel direction and being discharged from an air-blast nozzle bar disposed directly before a sheet pile beneath the travel path of the sheet. Due to the application of the air flow in a direction opposite to the direction of sheet travel, negative pressure or vacuum, which grips the sheet by suction, is produced at a rear or trailing side of the air-blast nozzle bar, and consequently generates frictional forces between the sheet and the air-blast nozzle bar, so that braking forces act upon the sheet which, in the interim, has been released by the sheet grippers of the transport system.

In the heretofore known devices of the foregoing general type, the oncoming sheets are successively braked from printing-press speed to zero speed, and are subsequently successively deposited on a sheet pile in the delivery of the printing press. The time available for the braking of the successive sheets is exceptionally brief due to the forcible successive braking, so that maximum possible braking forces act upon the sheets and subject them to correspondingly heavy loading. Consequently, a susceptibility to malfunction is increased and the possible printing-press speed is restricted. Previous attempts at improvement were concerned with optimizing the design of the braking means or to the introduction of post-grippers.

In the published German Patent Document DE 43 14 760 A1, a method is disclosed wherein metal plates are supplied to a braking device via conveyor belts and are decelerated, prior to being deposited on a metal-plate pile, by a braking device formed as a suction drum, so that an overlapping or shingled formation of the metal plates already occurs in the vicinity of the braking device.

Additionally, blowing devices disposed in the vicinity of the sheet brake are provided for supporting by vacuum the introduction of the trailing edge of the metal plate to the braking device.

SUMMARY OF THE INVENTION

It is accordingly an object of the invention to provide a method and device for braking sheets in a delivery of a sheet-fed printing press, wherein the time window available for braking sheets within the printing-press cycle is enlarged, thereby gaining more time for braking each of the sheets independently of the printing-press speed.

With the foregoing and other objects in view, there is provided in accordance with one aspect of the invention, a method for braking sheets in a delivery of a sheet-fed rotary printing press wherein the sheets are disposed in tandem and are successively fed to a sheet-pile position in translatory travel direction, the sheets being in an overlapping shingled arrangement in a vicinity of a sheet brake, an air-blast jet being applied beneath and parallel to the respective sheets, which comprises feeding the sheet to the sheet brake by means of gripper closure and a flotation-guiding arrangement, forming with the air-blast jet a carrying-air flow for producing the flotation-guiding arrangement and for simultaneously separating the sheets from an instant at which the sheets are being formed into the overlapping shingled arrangement, the carrying-air flow formed beneath an oncoming sheet continuing in the vicinity of the overlapping shingled arrangement of the sheets for forming an elongation of the flotation-guiding arrangement towards the delivery.

In accordance with another mode, the method according to the invention includes, upstream of the sheet brake, as viewed in the travel direction of the sheets, dividing the carrying-air flow of the flotation-guiding arrangement into a carrying-air flow for separating the shingled sheets, and an exhaust-air flow.

In accordance with a further mode, the method according to the invention includes translatorily moving the respective preceding sheet so as to determine the percentage share of the carrying-air flow for separating the shingled sheets, and the exhaust-air flow.

In accordance with another aspect of the invention, there is provided a device for braking and stacking sheets disposed in tandem and successively fed to a sheet-pile position in a translatory travel direction, the device having a flotation-guiding arrangement and a sheet brake, and comprising an exhaust-air duct disposed between the flotation-guiding arrangement and the sheet brake.

In accordance with another feature of the invention, the exhaust-air duct is disposed so as to be coverable by a preceding sheet.

In accordance with a further feature of the invention, the exhaust-air duct is formed with an opening having a cross section controllable in accordance with a rhythmic deposition of the sheets.

In accordance with an added feature of the invention, the flotation-guiding arrangement, the sheet brake, and the sheet pile are disposed substantially at the same level.

In accordance with an additional feature of the invention, each of the sheets being processed has a given thickness, the flotation-guiding arrangement is disposed at a given level, and the sheet brake is disposed at a level which is lower by the given thickness of one of the sheets than the level of the flotation-guiding arrangement.

In accordance with a concomitant feature of the invention, each of the sheets being processed has a given thickness, and the sheet pile has a given sheet-deposit level disposed lower by the given thickness of one of the sheets than the level of the sheet brake.

The shingled arrangement of sheets produces an extension or prolongation of the time available for the braking of an individual sheet. With the printing-press speed remaining unchanged, lower braking forces are required for acting upon the sheets or, in reverse, this shingled arrangement of sheets permits a higher printing-press speed, with unchanged braking forces acting upon the sheets.

The implementation of the method for braking the sheets in the delivery may be effected with braking devices such as braking tapes, suction rollers or the like acting mechanically upon the sheets, in conjunction with a mechanical sheet-transport system (gripper chains) for conveying the sheets to the delivery, or preferably by means of an air flow for braking the sheets, the air flow being directed in same direction as that of the sheet travel or transport in a flotation-guiding arrangement.

As noted hereinbefore, in an advantageous embodiment, the flotation-guiding arrangement, the sheet brake, and the sheet pile are disposed so as to be substantially at the same level so that, when thin, bendably soft paper is processed, a pile may be formed without creasing or wrinkling.

Other features which are considered as characteristic for the invention are set forth in the appended claims.

Although the invention is illustrated and described herein as embodied in a method and device for braking sheets in a delivery of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
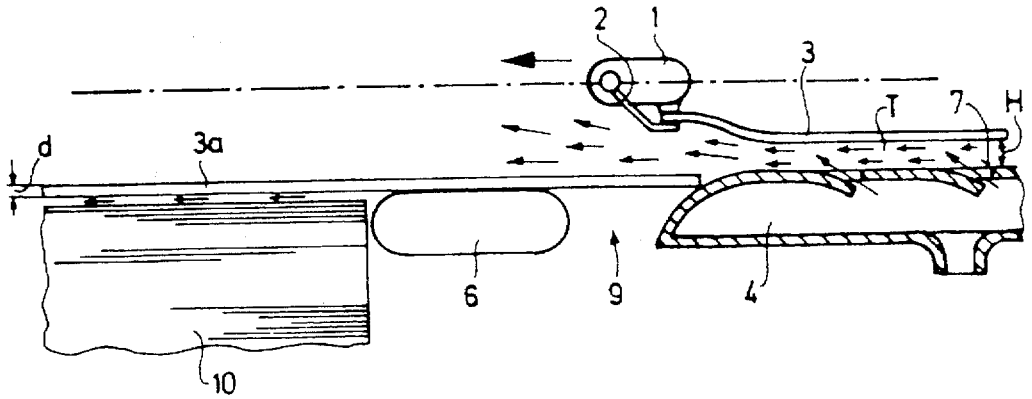
FIG. 1 is a side elevational view, partly in section, of a delivery provided with the sheet-braking device according to the invention, wherein sheets being formed into an overlapping or shingled arrangement in the delivery are shown, an exhaust-air duct of the device being completely covered in this operating phase of the sheet-braking device.
Figure 2:
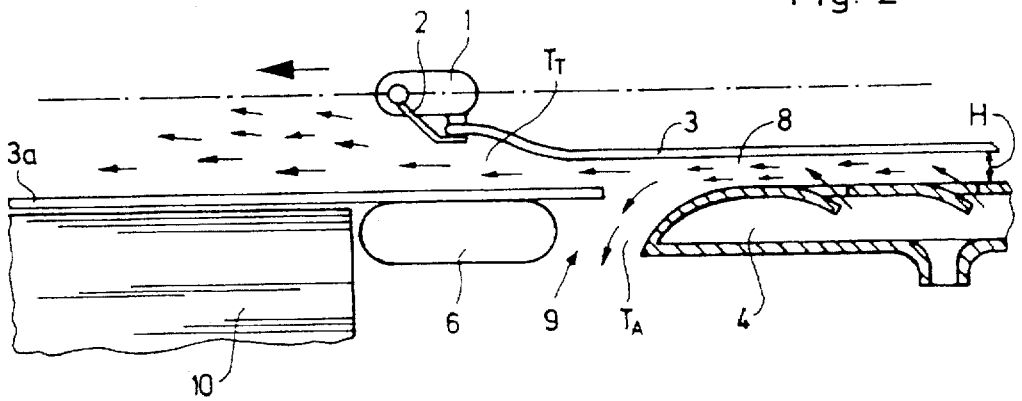
FIG. 2 is a view of FIG. 1 in another operating phase of the sheet-braking device, wherein the exhaust-air duct is partly uncovered, and showing the distribution of carrying-air flows.
Figure 3:
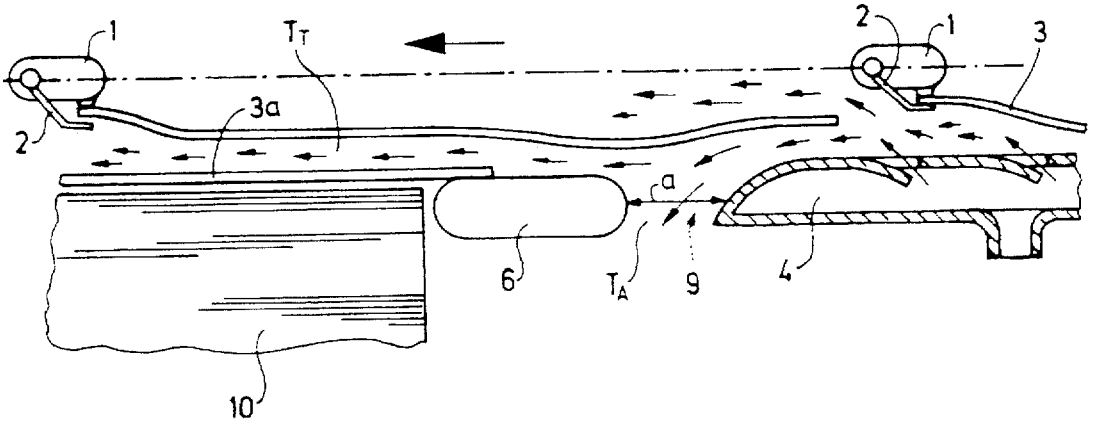
FIG. 3 is a view of FIGS. 1 and 2 in a further operating phase of the sheet-braking device, wherein the exhaust-air duct is fully open, and showing the shingled arrangement of the sheets in the delivery.
Figure 4:
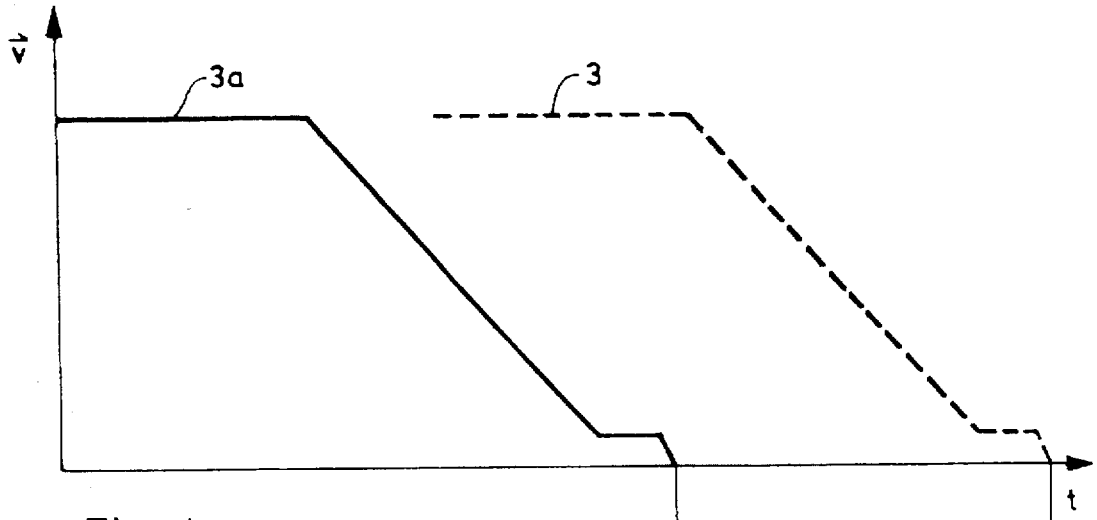
FIG. 4 is a speed-time graph of the sheet-braking device according to the invention.
Figure 5:
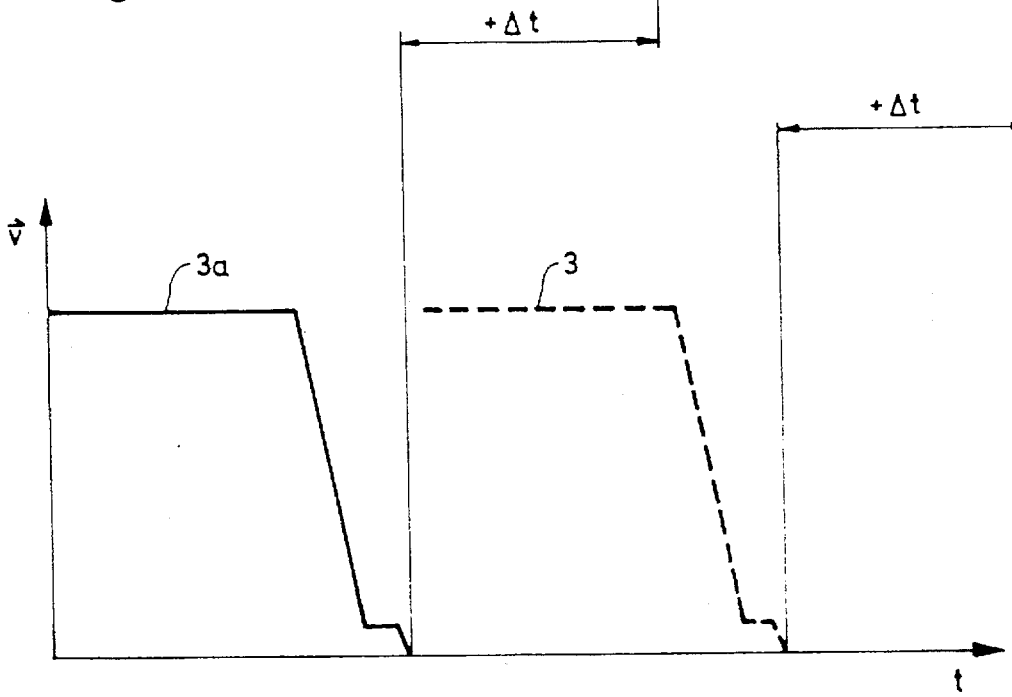
FIG. 5 is a speed-time graph of a conventional sheet-braking device.

Referring now to the drawings and, first, particularly to FIG. 1 thereof, there is shown therein, in an embodiment of the sheet-braking device according to the invention, a mechanical conveyor for conveying sheets from a last printing unit to a delivery of a sheet-fed rotary printing press, including gripper bars 1 fastened at spaced intervals to laterally revolving conveying chains, the gripper bars 1 extending across the width or breadth of a sheet and having laterally spaced-apart sheet grippers 2 gripping the leading edge of the sheet 3 to be transported and drawing it over a flotation-guiding arrangement 4 wherein blast air escaping in a sheet-conveying direction through openings 5 is directed beneath the transported sheet 3 and thus guided towards a delivery pile 10. A sheet brake 6 is disposed at an end of the flotation-guiding arrangement 4 directly before the sheet pile 10, as viewed in the sheet-conveying or sheet-travel direction. An upper side 7 of the sheet brake 6 lies approximately at the same level as that of the travel path 8 of the sheet 3 which, when being conveyed, is carried by the carrying-air flow T. Preferably, however, the upper side 7 of the sheet brake 6 is at a level which is lower by a thickness d of the printing material, i.e., the sheet 3*a*. Consequently, it is possible for the leading region of a sheet 3 following at printing-press speed to be drawn over the trailing region of the preceding sheet 3*a* remaining yet on the sheet brake 6, which holds the sheet 3*a* by the trailing region thereof, and is driven at a reduced speed compared to the transport speed of the sheet 3. This results in a time gain of an order of magnitude apparent from a comparison of the speed-time graphs in FIGS. 4 and 5, respectively representing a sheet-braking system employing the method according to the invention (FIG. 4) and a conventional sheet-braking system (FIG. 5). The time window available for sheet braking is considerably enlarged because the time for sheet braking can be extended in the region of overlap produced by the shingled arrangement of sheets.

The sheet brake 6 may be constructed as a mechanical sheet brake and may be formed, for example, of juxtaposed revolving suction tapes, a suction roller or the like which, however, revolves at a speed slower than the sheet-conveying speed to the delivery. The sheet brake 6 grips the sheet 3*a* at a trailing region thereof and simultaneously forms an extension or elongation of the flotation-guiding arrangement 4 for the succeeding sheet 3, as is readily apparent from FIG. 1.

As viewed in the sheet-conveying direction, the sheet brake 6 is disposed at a spaced distance a downstream from the flotation-guiding arrangement 4 so that an exhaust-air duct 9 providing an outlet to the carrying-air flow T produced by the flotation-guiding arrangement 4 is formed between the sheet brake 6 and the floatation-guiding arrangement 4, when the end of the respective preceding sheet 3*a* clears the cross-section of the opening to the exhaust-air duct 9. Depending upon the size of the cleared cross-section of the opening to the exhaust-air duct 9, the carrying-air flow T is divided into two branches ($T_T$, $T_A$). In this regard, the carrying-air flow $T_T$ remaining between the sheet 3 and the sheet 3*a* maintains the separation between the successively following sheets 3 and 3*a*, whereas the other carrying-air flow $T_A$ is guided into the exhaust-air duct 9.

A sheet 3 conveyed to the delivery by means of gripper bite or closure is fed to the sheet brake 6 on a carrying-air flow T. In this regard, the sheet 3 assumes a predetermined height (H=approx. 0,3 to 0,7 mm) above the flotation-guiding arrangement 4. The sheet brake 6 disposed downstream from the flotation-guiding arrangement 4, as viewed in the sheet-conveying direction, is disposed at substantially the same level as that of the flotation-guiding arrangement 4; in a preferred embodiment, the difference in height between the flotation-guiding arrangement 4 and the sheet brake 6 is equal to the thickness of the printing material d. The distance a between the flota- tion-guiding arrangement 4 and the sheet brake 6 determines the cross-section of the outlet to the exhaust-air duct 9.

The sheet pile 10 is disposed so that the deposit surface thereof (the uppermost sheet) is substantially level with the flotation-guiding arrangement 4 and the sheet brake 6, preferably lower than the sheet brake 6 by a distance equal to the thickness d of the printing material or sheet 3*a*.

From the flotation guidance, a carrying-air flow T with at least one velocity component directed in the travel direction of the sheet 3, 3*a* is flushed in a direction towards the sheet brake 6. This velocity component amounts to approximately from 50% to 150% of the conveying or travel speed of the sheet 3, 3*a*.

The sheet 3 is held by the leading edge thereof in the gripper system 1, 2 and fed to the sheet brake 6. In this regard, the sheet floats on a carrying-air flow T at a spaced distance H above the flotation-guiding arrangement 4. At this instant of time, the leading sheet 3*a*, which is already being transported at a reduced speed to the sheet pile 10, is located on the sheet brake 6. This leading or preceding sheet 3*a* thereby forms an extension or elongation of the guide plane formed by the flotation-guiding arrangement 4. Thus, the sheet 3 is already drawn over the sheet brake 6, without contacting the leading or preceding sheet 3a and without coming into contact with the sheet brake 6, respectively.

After a brief time interval, the leading or preceding sheet 3*a* partly clears the air outlet opening to the exhaust-air duct 9. In this regard, the carrying-air flow T divides into a partial air flow $T_A$ which is discharged through the exhaust-air duct 9, and a partial air flow $T_T$ which ensures the separation of the two sheets 3 and 3*a*. After another time interval, the leading or preceding sheet 3*a* completely clears the exhaust-air duct 9 so that the exhaust-air flow $T_A$ is intensified and the separating-air flow $T_T$ is reduced. In so doing, one end of the sheet 3*a* reaches the sheet brake 6 cleared by the leading or preceding sheet 3*a*. Simultaneously, the gripper 2 opens and releases the leading edge of the sheet 3. The trailing edge of the sheet 3 then deposits on the sheet brake 6, while the front or leading region thereof floats onto the previously blown-in air cushion $T_T$. This air cushion $T_T$ gradually escapes from between the sheet 3*a* deposited on the sheet pile 10 and the following sheet 3 so that the sheets 3 and 3*a* contact one another only when there is no longer any translatory motion.

I claim:

1. Method for braking sheets in a delivery of a sheet-fed rotary printing press, which comprises:

providing a gripper for transporting sheets, a sheet brake receiving the sheets released from the gripper for braking the sheets, and a flotation-guide having an air-blast jet for transporting the sheets from the gripper to the sheet brake in an overlapping shingled arrangement of the sheets on the sheet brake;

providing a sheet pile delivery receiving the shingled sheets from the sheet brake; and forming with the air-blast jet a carrying-air flow for producing a flotation-guide plane in a sheet transport direction and for simultaneously separating the sheets from an instant at which the sheets are being placed in the overlapping shingled arrangement, the carrying-air flow formed beneath an oncoming sheet continuing beneath the overlapping shingled arrangement of the sheets, and forming, with the sheets, an elongation of the flotation guide-plane towards the delivery.

2. Method according to claim 1, which includes, upstream of the sheet brake, as viewed in the travel direction of the sheets, dividing the carrying-air flow of the flotation-guide into a carrying-air flow for separating the shingled sheets, and an exhaust-air flow.

3. Method according to claim 2, which includes translatorily moving the respective preceding sheet for determining the percentage share of the carrying-air flow for separating the shingled sheets, and the exhaust-air flow.

4. Device for braking and stacking sheets disposed in tandem and successively fed to a sheet-pile position in a translatory travel direction, the device, comprising:

a flotation-guiding arrangement;

a sheet brake for receiving shingled sheets;

an exhaust-air duct disposed between said flotation-guiding arrangement and said sheet brake; and said flotation-guiding arrangement, said sheet brake, and said sheet pile being disposed at the same height.

5. Device according to claim 4, wherein said exhaust-air duct is disposed so as to be coverable by a preceding sheet.

6. Device according to claim 4, wherein said exhaust-air duct is formed with an opening having a cross section configured in accordance with deposition requirements of the sheets.

7. Device according to claim 4, wherein each of the sheets being processed has a given thickness, said flotation-guiding arrangement is disposed at a given height, and said sheet brake is disposed at a height which is lower by the given thickness of one of the sheets than the height of said flotation-guiding arrangement.

8. Device according to claim 4, wherein each of the sheets being processed has a given thickness, and the sheet pile has a given sheet-deposit level disposed lower by the given thickness of one of the sheets than the level of the sheet brake.

* * * * *